United States Patent [19]

Alazet

[11] Patent Number: 5,067,199

[45] Date of Patent: Nov. 26, 1991

[54] SUCTION DEVICE WITH A SQUEEGEE FOR ELIMINATING DIRTY WATER WHILE CLEANING CERTAIN SURFACES

[76] Inventor: Jean Alazet, 26, rue des Fossés St. Bernard, 75005 Paris, France

[21] Appl. No.: 592,118

[22] Filed: Oct. 2, 1990

[30] Foreign Application Priority Data

Oct. 13, 1989 [FR] France ..... 89 13394

[51] Int. Cl.[5] ..... A47L 7/00

[52] U.S. Cl. ..... 15/320; 15/322; 15/393; 15/397; 15/401

[58] Field of Search ..... 15/320, 322, 393, 396, 15/397, 401, 402

[56] References Cited

U.S. PATENT DOCUMENTS

| | | | |
|---|---|---|---|
| 1,026,104 | 5/1912 | Moorehead | 15/401 X |
| 1,042,711 | 10/1912 | Moorehead | 15/397 X |
| 2,168,692 | 8/1939 | Vidal . | |
| 2,822,061 | 2/1958 | Pettit et al. . | |
| 2,832,086 | 4/1958 | Wells | 15/401 X |
| 3,107,387 | 10/1963 | Katt . | |
| 3,118,165 | 1/1964 | Meyerhoefer | 15/402 |
| 3,195,166 | 7/1965 | Wisner | 15/396 X |
| 3,584,330 | 6/1971 | Wallin et al. | 15/401 X |
| 4,817,233 | 4/1989 | Waldhauser . | |

FOREIGN PATENT DOCUMENTS

| | | |
|---|---|---|
| 2485405 | 12/1981 | France . |
| 2078496 | 2/1982 | United Kingdom . |
| 2173549 | 10/1986 | United Kingdom . |

*Primary Examiner*—Chris K. Moore

*Attorney, Agent, or Firm*—Young & Thompson

[57] ABSTRACT

The cleaning device comprises a squeegee (1) formed of a blade of elastic material, inside which are formed suction ducts (5) which open in at least one face of the blade through orifices (7) aligned in parallel with the lowermost edge (8) of the squeegee, close to that edge. The suction ducts (5) are connected with flexible tubes (10) passing through a roller-type pump (11) towards a collector tank (15) in which the dirtied cleaning liquid to be eliminated is collected. This device may be used for removing a cleaning liquid having previously been spread over a surface which is to be cleaned.

5 Claims, 3 Drawing Sheets

FIG. 3
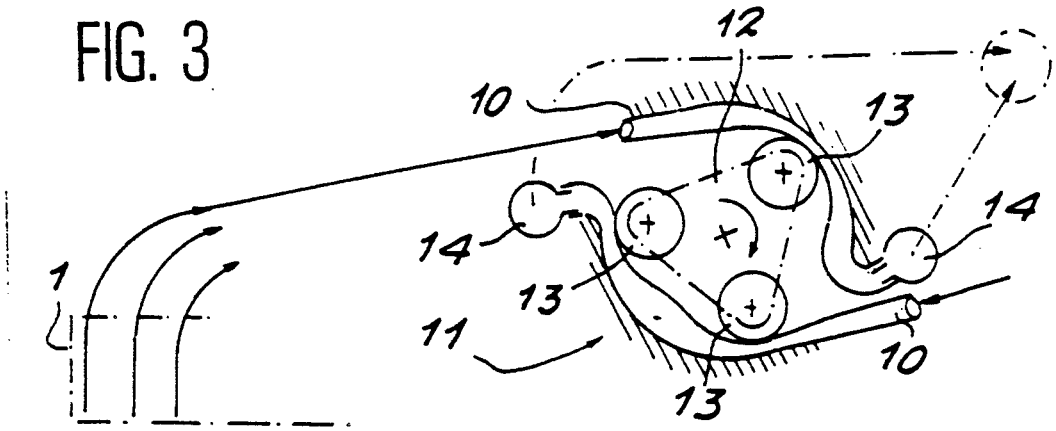
FIG. 4
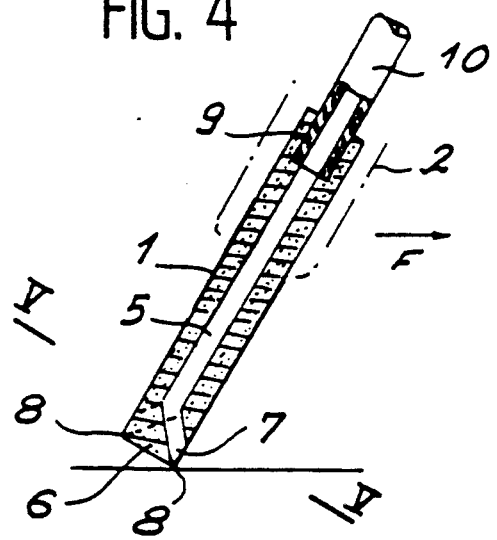
FIG. 5
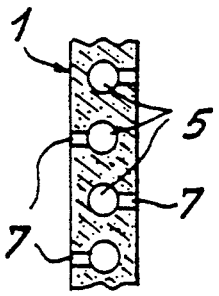
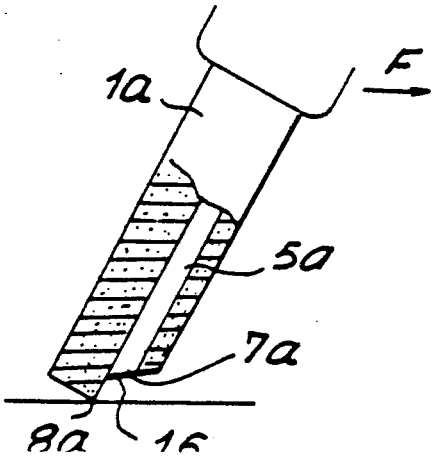
FIG. 6

SUCTION DEVICE WITH A SQUEEGEE FOR ELIMINATING DIRTY WATER WHILE CLEANING CERTAIN SURFACES

FIELD OF THE INVENTION

This invention relates to suction devices equipped with a squeegee, which may be adapted on the tip of a handling stick or of a gripping handle, for eliminating dirty water while cleaning surfaces. Devices of this kind comprise an elastic scraper or squeegee, together with suction orifices or channels through which may be sucked out the cleaning liquid previously spread over the surface to be cleaned, by means of a pump connected to a collecting tank.

PRIOR ART

French Patent No. 2,485,405 describes a cleaner head equipped in the above-stated manner. This head comprises a liquid-permeable pad for spreading a cleaning liquid, together with squeegees disposed on both front and rear frontal faces of this head, suction holes being provided in registry with both squeegees. When this cleaning head is moved over the surface to be cleaned, the squeegee located at the rear will push forward, in front of itself, the liquid previously spread on this surface, so that this liquid may be sucked out through the corresponding suction holes. In fact, the design principle of this cleaning head is such that, in operation, the squeegee will only allow to remain on the treated surface, a liquid film capable of disappearing quickly through drying.

However the actual operating conditions of this type of cleaning head are not fully satisfactory and do not provide the expected result. More particularly, the effectiveness of suction of the liquid to be eliminated is insufficient. This is mainly due to the fact that the suction orifices are located too far away from the contact edge of the squeegee with the surface being treated.

This is why the present invention has for its purpose to provide a sucking squeegee device design in such manner that the suction of the cleaning liquid may be achieved with maximum effectiveness.

BRIEF DISCLOSURE OF THE INVENTION

To the above aim, the device according to the invention is essentially characterized in that:

the squeegee of this device consists in a blade of elastic material inside which are formed suction ducts opening in at least one of the two faces of this squeegee, through orifices which are aligned in parallel with the lowermost corresponding edge of this squeegee, and in close vicinity thereto;

the suction ducts being thus provided are connected with flexible hoses which end up in a suction pump of a peristaltic type, the outlet of which is connected to a collector tank in which the dirtied cleaning liquid to be eliminated is collected.

Due to the very fact of the specific design of the squeegee provided in the device according to the invention, the suction of the liquid to be eliminated is achieved under optimal conditions of effectiveness. This makes it actually possible therefore to suck out the liquid until there remains merely an extremely thin liquid film on the treated surface, this film being capable of disappearing very quickly through drying.

It will be appropriate to point out that the present invention also has for its object the squeegee of a particular design which is intended for equipping the cleaning device such as defined hereinabove.

In one particular embodiment of this device, the device is further provided with a brush or other member adapted for spreading a cleaning liquid delivered from a tank connected to this spreader member through one or several feed lines.

Further features and advantages of the device according to the invention will appear from the following description, given with reference to the appended drawings, shown by way of example, in which:

FIG. 3 is a diagram illustrating the operation mode of the suction pump provided in this cleaning device;

FIG. 4 is a diagrammatic view, in transversal cross-section, of the squeegee equipping the present cleaning device;

FIG. 5 is a view, in transversal cross-section, taken along line V—V of FIG. 4;

FIG. 6 is a view similar to FIG. 4, illustrating another embodiment of the cleaning squeegee;

DETAILED DESCRIPTION OF THE INVENTION

Figure 1:
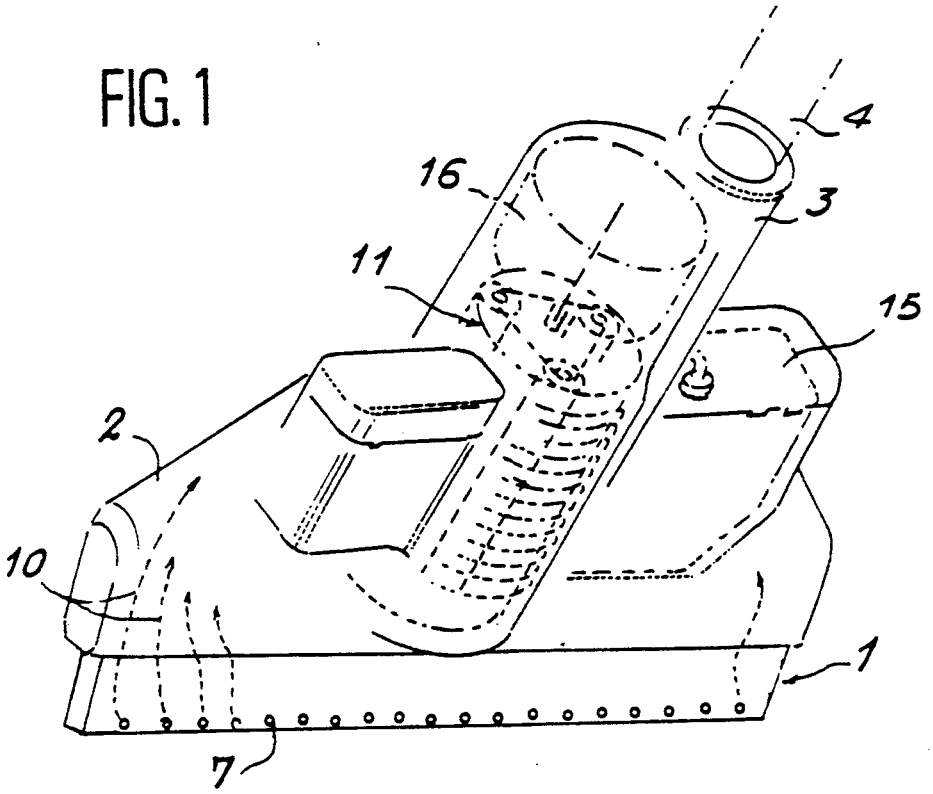
FIG. 1 is a diagrammatic perspective view of a first embodiment of the cleaning device according to the invention.

In the embodiment illustrated in FIGS. 1–4, the cleaning device according to this invention comprises a squeegee 1 made of elastic material, with one of its longitudinal edges fixed to a rigid housing 2 of elongated shape. In the center of this housing is provided a sleeve 3 intended for receiving a handling stick 4 or, alternatively, a gripping handle. In the first case, the present device may be used for cleaning a smooth floor surface, for instance a tiled floor, or similar, whereas in the second case the device may be used for cleaning any other smooth surfaces such as e.g. window panes or vertical walls and partitions, etc..

The squeegee 1 is formed of a flat strip of rectangular shape, made of elastic material, e.g. natural or synthetic rubber, or else a plastic material. According to the invention, a series of suction ducts 5 are formed within the thickness of the body of the squeegee 1, these ducts extending in parallel to the two longer faces of the squeegee. At the end 6 of the squeegee, lying opposite to the housing 2, the ducts 5 are alternatively bent towards both longer faces of the squeegee, and they open to the exterior through orifices 7. These orifices are located in very close vicinity to either of the edges 8 of the squeegee, according to which one of these edges is contacting the surface being treated, as the squeegee is tilted towards either side (see FIG. 4). These orifices 7 are aligned in parallel with the adjacent edge 8.

Figure 2:
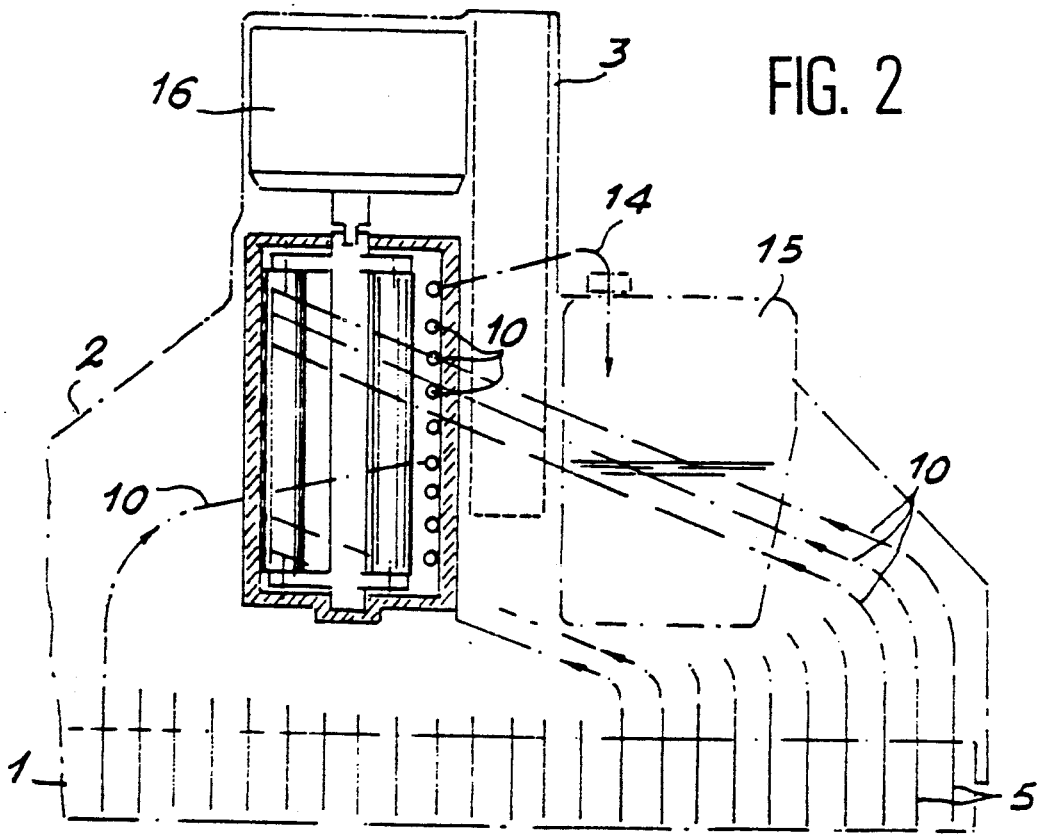
FIG. 2 is a partial diagrammatic view, in longitudinal cross-section.

Along the opposite edge of the squeegee 1, the suction ducts 5 end into outlet orifices 9, to each of which is connected a flexible suction tube 10. The various tubes 10 end up in a suction pump generally designated 11. This pump is preferably of a peristaltic type, in which the flexible tubes 10 are distributed into two separate groups arranged on either side of the rotor 12 of this pump, so that they will successively be squeezed by the rollers 13 carried by the rotor (see FIG. 3), this action ensuring that the liquid to be eliminated will be sucked out, without any risk of the pump becoming drained out. On their terminal ends, the flexible tubes 10 are connected to pipings 14 leading to a tank 15 provided for collecting the dirtied cleaning liquid. This tank can be emptied periodically. As shown in FIGS. 1 and 2, the tank 15 and the pump 11 are arranged on either side of the sleeve 3 along the length of the housing 2. These two elements are fixed to the housing or included therein. The same applies to the electric motor 16 provided for driving the rotor of the pump 11, as well as to the reloadable batteries provided for energizing the motor 16.

The cleaning device being thus constituted is intended for being applied to the surface which is to be treated after having been cleaned with an appropriate cleaning liquid which may be spread in any required manner. The application of the present device has the purpose of eliminating the liquid present on the floor surface S so as to only leave behind a very thin liquid film, capable of disappearing quickly by drying. For this purpose, it will be appropriate to slide the squeegee along the floor surface while placing the assembly in the slanted position shown in FIG. 4. The squeegee will then be contacting the floor surface with its lower edge 8 located forwardly. Under these conditions, this edge 8 will push forward the cleaning liquid present on the floor, so that this liquid will be immediately sucked away through the orifices 7 located on the front face of the squeegee. Since the suction ducts 5 are formed directly within the squeegee, while their inlets 7 open in immediate vicinity to the edge 8 in the working position, suction of the liquid takes place in optimal conditions of effectiveness. Obviously, in such a case, suction is done solely through the ducts 5 which open in that face of the squeegee which is located forwardly. However, due to the fact that inlets 7 are provided on both faces of the squeegee 1, the present cleaning device may be used with a slant in either direction.

FIG. 6 illustrates a modified embodiment of the squeegee in the cleaning device of this invention. In this embodiment, the squeegee 1*a* is formed with a stepped indentation 16 along one of the edges of its working end. The suction ducts 5*a* are formed within that portion of the squeegee body which overlies this stepped indentation. The inlets 7*a* of these ducts are located in this cut-out area, in immediate vicinity to the adjacent edge 8*a* of the working end of the tool 1*a*.

As a result, with this embodiment, the squeegee 1*a* will always need to be oriented in the position shown in FIG. 6, in order that the cleaning heads may be moved in the direction of arrow F. Thus, the same advantages will be obtained as with the first embodiment, namely that the liquid to be eliminated will be sucked in the immediate vicinity of the edge 8*a* which is scraping the smooth surface.

Figure 7:
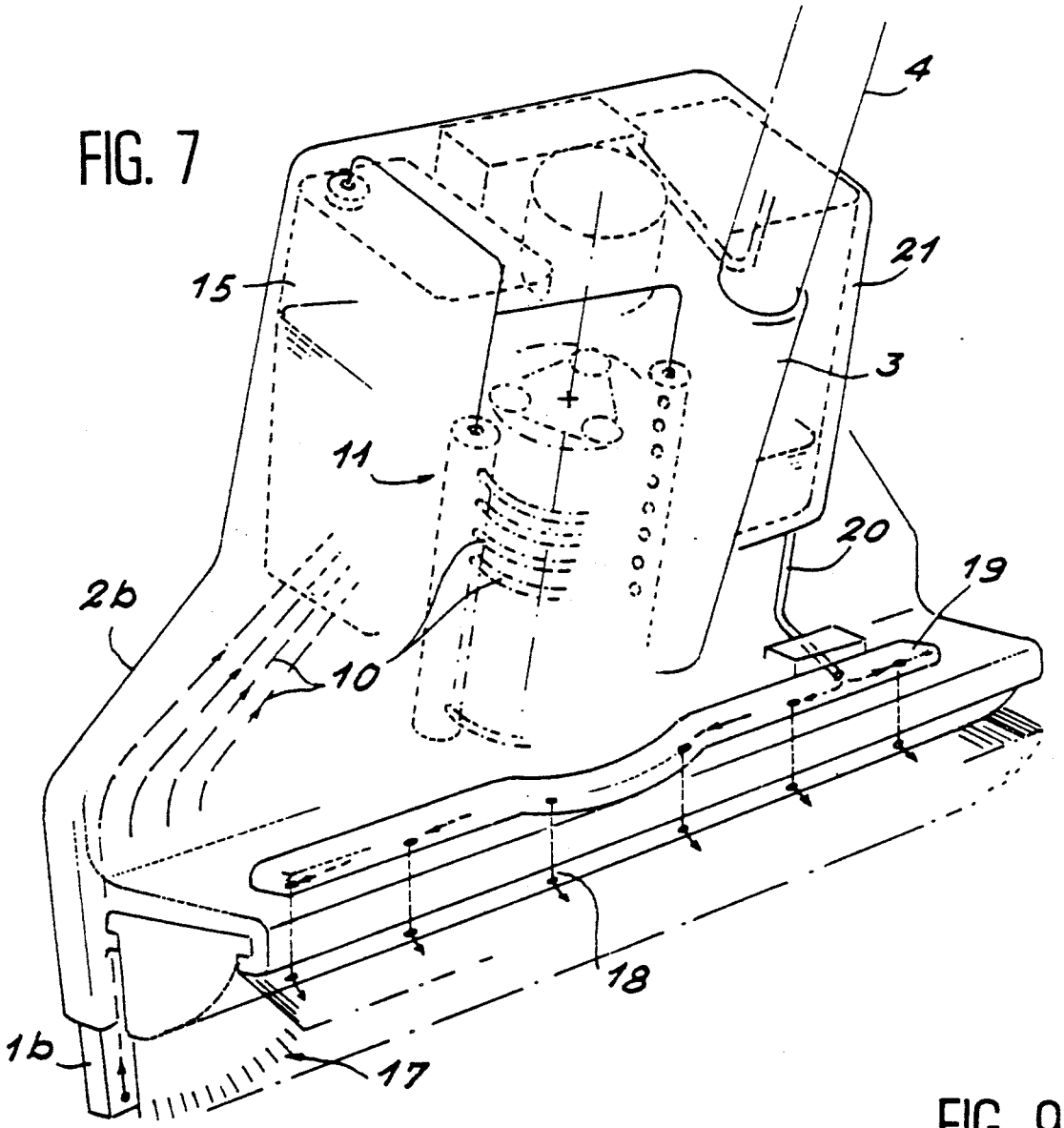
FIG. 7 is a diagrammatic perspective view of a further embodiment of the cleaning device of the invention.
Figure 8:
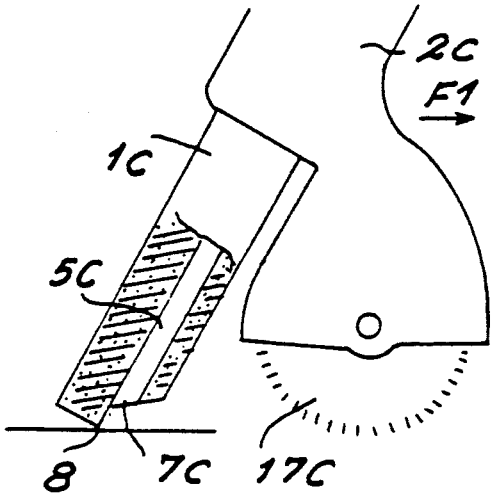
FIG. 8 is a partial view in transversal cross-section of the lower part of this cleaning device.

FIGS. 7 and 8 show yet another embodiment of the cleaning device of the invention. In this embodiment, the housing 2*a* of the cleaning head carries, in addition to the elastic squeegee 1*b*, a brush 17 placed in registry with one of the longer faces of the squeegee, which is provided for applying a cleaning liquid over the surface to be cleaned. Cleaning liquid is fed to the brush through a series of small channels 18 which open in registry with the brush. These channels are connected to a feed manifold 19 provided on the housing 2*b* or therein, this manifold being connected through a duct 20 to a tank 21 containing a supply of cleaning liquid. This tank has a removable closing member allowing it to be refilled at intervals.

On another hand, the cleaning device of FIGS. 7 and 8 includes, in addition to the already mentioned squeegee 1*b*, the same elements as in the previous embodiment. It comprises, therefore, a roller pump 11, inside which pass flexible suction tubes 10 connected to the outlets of the suction ducts 5 formed within the thickness of the squeegee 1*b*. The terminal ends of these tubes 10 are connected to a tank 15 provided for collecting the dirtied cleaning liquid after suction through the pump 11. Obviously, the housing 2*b* also carries a sleeve 3 for receiving a handling stick 4 or else, a gripping handle.

The cleaning device shown in FIGS. 7 and 8 is intended for being moved along the surface to be cleaned, in contact therewith, with a different inclination. When the device is tilted to the position shown in FIG. 8 for moving it along the direction of arrow F, it will be possible to remove the cleaning liquid which has previously been spread on the floor, in the same manner as with the embodiment of FIGS. 1–4. However, when tilting this same device in the opposite direction, and making it slide in the direction opposite to arrow F, it becomes possible to use the brush 17 for initially applying the cleaning liquid over the surface to be treated. These two operations may therefore be carried out successively, using a single tool.

Figure 9:
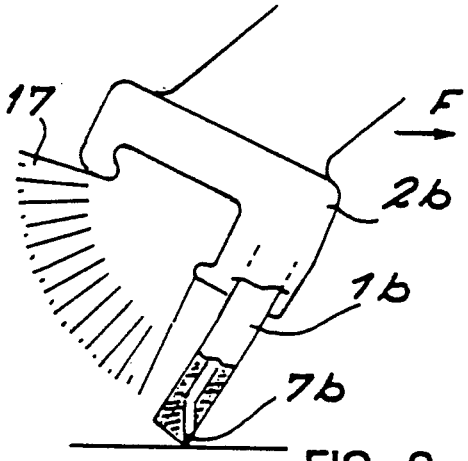
FIG. 9 is a view similar to FIG. 8, illustrating a modified embodiment of the lower portion of the cleaning device of FIG. 7.

FIG. 9 shows a further embodiment of the cleaning device of FIGS. 7 and 8. In this modified embodiment, the lower portion of the housing 2*c* of this device is provided with a rotary brush 17*c* disposed in registry with that face of the squeegee 1*c* at the end of which are opening the suction ducts 5*c* formed within the thickness of this squeegee. This rotary brush is provided as a replacement for the fixed brush provided in the embodiment of FIGS. 7 and 8. However, since this rotary brush 17*c* is disposed in face of the suction orifices 7*c*, instead of being on the opposite side, the cleaning device thus constituted is capable of being moved over the surface to be cleaned in one direction only, namely direction $F_1$, for spreading the cleaning liquid over the surface to be cleaned as well as for sucking out this liquid from behind the brush 17*c* through the ducts 5*c* of the squeegee.

However, many other embodiments of the invention may be envisioned. For instance, the brushes 17 and 17*c* could be replaced with any other suitable spreading members for the cleaning liquid, such as e.g. a porous or sponge-like pad. As already mentioned in respect of the embodiments of FIGS. 7 and 8, on the one hand, and of the embodiment of FIG. 9, on the other hand, this spreader member may be located either facing the longer face of the squeegee, in which the suction ducts are opening, or else on the opposite longer face. However, it is also possible to provide a squeegee of the type shown in FIGS. 4 and 5, that is, a squeegee with suction ducts opening in both longer faces.

Also, the housing of the cleaning device may take a widely different shape from the one shown on FIGS. 1–7, which is more particularly designed for cleaning floors. In fact, in the case of a device intended for cleaning window panes or any other vertical surfaces, the housing may have a very different shape, so that it may easily be held in the hand by means of a gripping handle.

Due to its advantageous features, the cleaning device according to this invention may be used effectively for cleaning various kinds of smooth surfaces. As already stated, the invention also has for its object the cleaning squeegees specially designed for equipping the cleaning devices which have previously been described herein.

What is claimed is:

1. A suction device with a squeegee for eliminating dirtied water after the cleaning of certain surfaces, of the type comprising an elastic squeegee as well as suction orifices or ducts for sucking out the cleaning liquid spread on such a surface, by means of a pump connected to a collector tank, wherein:

the cleaning squeegee (1, 1*a*, 1*b*, 1*c*) consists in a blade of elastic material within which are formed suction ducts (5, 5*a*, 5*b*) opening in at least one of the two faces of said squeegee through orifices (7, 7*a*, 7*b*) aligned in parallel with the corresponding lowermost edge (8) of said squeegee and in close vicinity to said edge;

the suction ducts (5, 5*a*, 5*b*) thus provided are connected with at least one flexible tube (10) leading to a roller-type pump (11) which is further connected to a collector tank (15) for collecting the dirtied cleaning liquid which is to be eliminated.

2. A device according to claim 1, wherein there is further provided means (17, 17*c*) for spreading a cleaning liquid supplied from a tank (21) connected to said spreading member through at least one feed line (20).

3. A cleaning squeegee according to claim 1, in which the suction ducts (5) are bent at an angle near their inlet end so that they open through one of the longer faces of said squeegee through inlet orifices located in the immediate vicinity of the corresponding edge (8) of said squeegee.

4. A cleaning squeegee according to claim 1, wherein the suction ducts (5) open alternately in opposite long faces of said squeegee through orifices (7) located in the immediate vicinity of both corresponding edges (8) of said squeegee.

5. A cleaning squeegee according to claim 1, characterized in that it comprises, on its working end and along one of its longer faces, a stepped indentation (16), while the suction ducts (5*a*) formed within the thickness of said squeegee open at the location of said stepped indentation (16) through inlet orifices (7*a*).

* * * * *